United States Patent [19]

Zaslavsky et al.

[11] Patent Number: 4,950,961

[45] Date of Patent: Aug. 21, 1990

[54] STARTING CIRCUIT FOR GASEOUS DISCHARGE LAMPS

[75] Inventors: Gregory Zaslavsky, Brookline; Sheppard Cohen, Danvers, both of Mass.

[73] Assignee: GTE Products Corporation, Danvers, Mass.

[21] Appl. No.: 936,069

[22] Filed: Nov. 28, 1986

[51] Int. Cl.[5] ..... H05B 41/14

[52] U.S. Cl. ..... 315/289; 315/240; 315/290

[58] Field of Search ..... 315/289, 290, 97, 101, 315/209 R, 240

[56] References Cited

U.S. PATENT DOCUMENTS

| | | | |
|---|---|---|---|
| 3,383,558 | 5/1968 | Waymouth | 315/242 |
| 3,917,976 | 11/1975 | Nuckolls | 315/258 |
| 3,963,958 | 6/1976 | Nuckolls | 315/276 |
| 4,072,878 | 2/1978 | Engel et al. | 315/205 |
| 4,143,304 | 3/1979 | Hitchcock et al. | 315/276 |
| 4,210,850 | 7/1980 | Britton | 315/290 |
| 4,275,337 | 6/1981 | Knoble et al. | 315/289 |
| 4,347,462 | 8/1982 | Adachi | 315/290 |
| 4,381,476 | 4/1983 | Adachi et al. | 315/101 |
| 4,399,390 | 8/1983 | Oshita et al. | 315/101 |
| 4,404,029 | 9/1983 | Iwaya et al. | 252/521 |
| 4,415,837 | 11/1983 | Sodini | 315/177 |
| 4,438,369 | 3/1984 | Hicks et al. | 315/209 R |
| 4,461,982 | 7/1984 | Fähnrich | 315/289 |
| 4,473,778 | 9/1984 | Adachi | 315/101 |
| 4,513,227 | 4/1985 | Labadini et al. | 315/290 |
| 4,572,988 | 2/1986 | Handler et al. | 315/240 |

FOREIGN PATENT DOCUMENTS

| | | |
|---|---|---|
| 3330266 | 2/1984 | Fed. Rep. of Germany . |
| 2055516 | 3/1981 | United Kingdom . |

*Primary Examiner*—Eugene R. Laroche
*Attorney, Agent, or Firm*—Carlo S. Bessone

[57] ABSTRACT

A starting and operating circuit for gaseous discharge lamps which includes a pair of input terminals for connection to an alternating current supply and a pair of output terminals for connection across the lamp. A ballast inductor is connected at its ends in series between one of the input terminals and one of the output terminals. A pulse generator is connected between one of the input terminals and one of the output terminals and another pulse generator is connected between a tapping point on the ballast inductor and the outer input terminal or the other output terminal or a point on the connection therebetween. The high voltage pulse generator includes a non-linear capacitor (NLC) and a semiconductor bipolar thyristor (commonly known as SIDAC) connected in series, the non-linear capacitor and the bipolar thyristor being connected in parallel with the lamp.

12 Claims, 3 Drawing Sheets

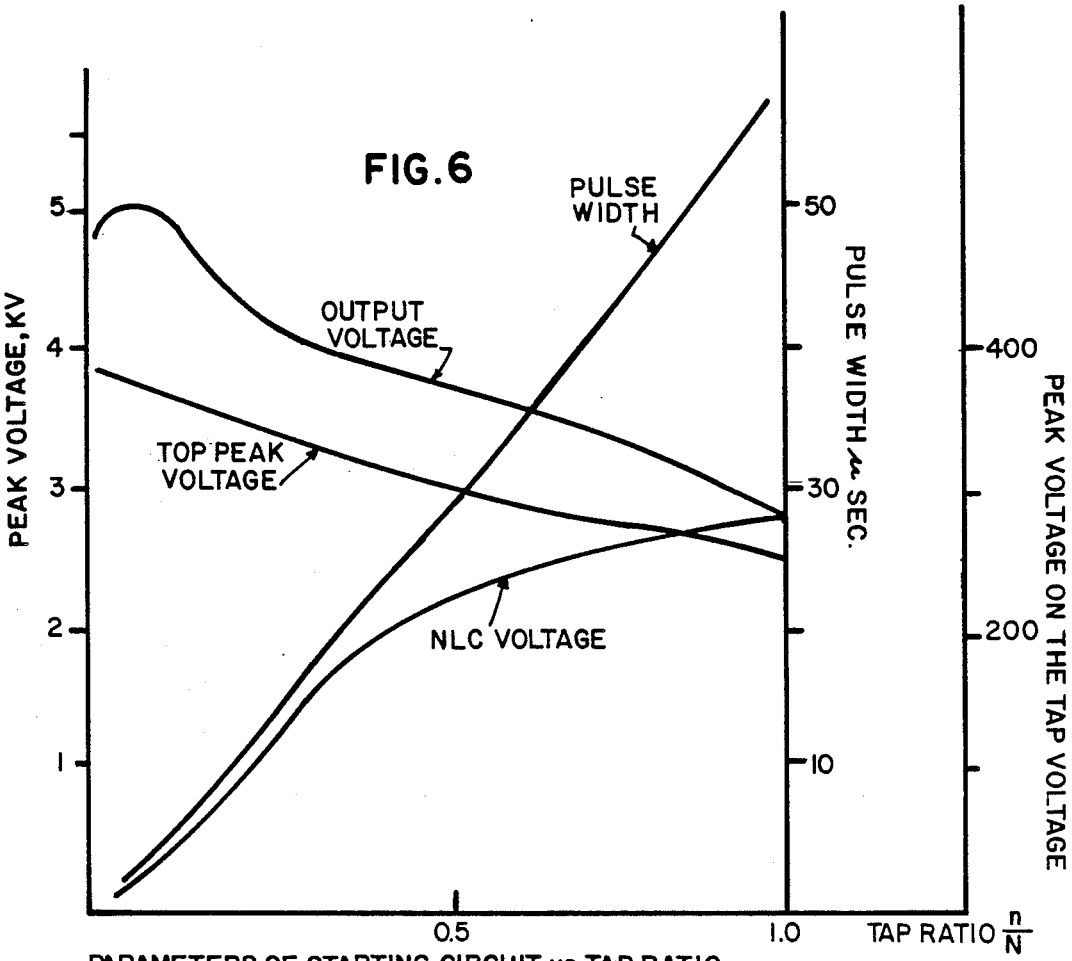
PARAMETERS OF STARTING CIRCUIT vs TAP RATIO
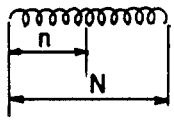
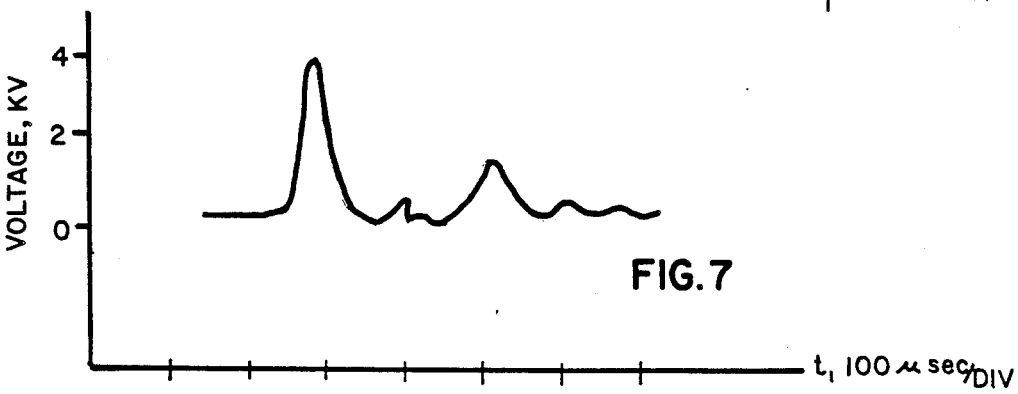
SCOPE OF OUTPUT VOLTAGE IN CASE OF SLOW SIPAC

STARTING CIRCUIT FOR GASEOUS DISCHARGE LAMPS

FIELD OF INVENTION

The present invention relates to high pressure gaseous discharge lamps and more particularly to a starting circuit which provides pulse voltages for initiating the discharge in such lamps.

BACKGROUND OF THE INVENTION

Gaseous discharge lamp starting circuits are well known in the art. Generally, gaseous discharge lamps require a higher voltage for ignition than for operation. This occurs because most cold gases act as insulators at ignition time, whereas during operation, the hot vapors become conductive. The high voltage requirements for ignition of discharge lamps can be accomplished by applying high open circuit voltages at the line frequency across the discharge lamp or employing starting circuits which provide high voltage pulses to generate initial discharge in the lamp.

A number of high-pressure sodium discharge lamp lighting circuits have been developed in recent years such as those disclosed in U.S. Pat. No. 4,072,878 to Engel et al. The Engel patent discloses an apparatus that provides for high-voltage pulses for starting a sodium discharge lamp by using the breakdown characteristics of a Zener diode to provide accurately timed starting pulses. The use of the Zener diode eliminates timing problems encountered when the breakdown characteristics of a glow lamp are used in somewhat similar fashion, as described in U.S. Pat. Nos. 3,917,976 and 3,963,958 to Nuckolls.

Another apparatus for starting and operating a high-pressure sodium lamp is disclosed in U.S. Pat. No. 4,143,304 to Hitchcock et al. The Hitchcock apparatus uses a voltage amplification circuit, utilizing two individual capacitors, the output of which is applied across the ballast reactor which is connected to the reactor in autotransformer relationship. Although the Hitchcock circuit works well, it does require a relatively large number of circuit components.

Further, various discharge lamp starting devices have been developed which employ non-linear dielectric elements. For example, U.S. Pat. Nos. 4,404,029 to Iwaya et al; 4,381,476 to Adachi et al; 4,399,390 to Oshita et al; 4,347,462 to Adachi and 4,513,227 to Labadini et al. The references show many variations in the use of starting circuits and devices which utilize the pulse generating capabilities of non-linear dielectric elements.

Further, in a co-pending application, Ser. No. 936,218 and assigned to the assignee of the present application, there is disclosed a starting and operating circuit for discharge lamps which employs a non-linear capacitor (NLC) in combination with a bipolar thyristor (SIDAC) and a voltage triggered switch. Therein, the inductive reactance ballast is a component of the starting circuit which generates the voltage pulses. The output voltage is limited by the inductance of the ballast. Thus, while the disclosed starting circuit provides improvement, the magnitude of the voltage pulse is increased by either increasing the inductance of the ballast or increasing the capacitance of the non-linear capacitor. Since the size of the inductance is essentially established, the non-linear conductor must be large enough to satisfy the starting requirements of the lamp with the possible resultant loss of desired small size and cost.

While such devices provide results in the areas intended, there still exists a need to provide a starting circuit for discharge lamps which employs inexpensive small components while providing a wide range of voltage pulses.

Accordingly, an object of the present invention is to provide an improved starting circuit for gaseous discharge lamps.

Still another object of the present invention is to provide a starting circuit which has a range of pulse voltages for initiating discharge which is simple and economical in construction and reliable in operation.

SUMMARY OF THE INVENTION

In accordance with the present invention, there is provided a starting and operating circuit for gaseous discharge lamps. The circuit comprises a pair of input terminals for connection to an alternating current supply and a pair of output terminals for connection across the lamp. A ballast inductor is connected at its ends in series between one of the input terminals and one of the output terminals. A high voltage starting pulse generator means is connected between one of the input terminals and one of the output terminals and another pulse generator means is connected between a tapping point on the ballast inductor and the other input terminal or the other output terminal or a point on the connection therebetwen. The high voltage starting pulse generator comprises a non-linear capacitor (NLC) and a semiconductor bipolar thyristor (commonly known as SIDAC) connected in series, the non-linear capacitor and the bipolar thyristor being connected in parallel with the discharge lamp.

In another embodiment of the invention, paralleling components which serve as voltage divider means are connected in parallel with the bipolar thyristor to further delay the application of line voltage to the non-linear capacitor thereby requiring a longer time for the NLC to be fully charged. The paralleling components can be capacitors or resistors with operating ranges dependent upon the particular circuit. Such paralleling components provide a more stable operation of the starting circuit. In another aspect of the invention, a variable resistor means can serve as the parallel component whereby the phase and magnitude of the generated pulse can be varied.

BRIEF DESCRIPTION OF THE DRAWINGS

FIG. 6 is a graph indicating the relationship of tap ratio and parameters of the starting circuit of the invention.

FIG. 7 shows the output voltage when using a slow switching SIDAC.

DESCRIPTION OF THE PREFERRED EMBODIMENTS

Figure 1:
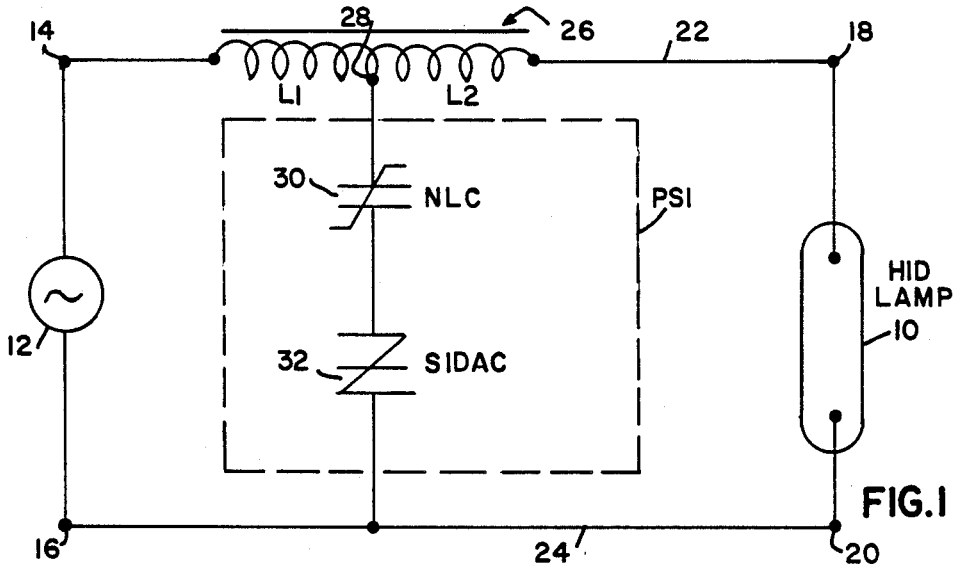
FIG. 1 is a circuit diagram of a discharge lamp starting and operating circuit showing an embodiment of the invention.

Referring now to FIG. 1, there is shown an embodiment of the starting circuit of the present invention for a gaseous discharge lamp 10 which may be a high intensity discharge (HID) lamp such as sodium or other metal halide vapor lamp which uses a high voltage pulse for lamp ignition and uses a lower voltage for continued operation of the lamp, once ignited. The starting circuit is powered from a source of AC power 12 fed to input terminals 14 and 16 of the circuit. The lamp 10 is connected to output terminals 18 and 20 and to the AC power input terminals at line conductors 22 and 24. An inductive reactance ballast, 26, such as in the form of an iron core and induction coil, is connected in series with lamp 10 to provide a current limiting impedance as is conventional in discharge lamp circuits. A high voltage pulse generator starting circuit PS1 is connected between the tapping point 28 on inductor L1 and L2 and the input terminal 16 and comprises a non-linear capacitor (NLC) 30 and a semiconductor bipolar thyristor switch (SIDAC) 32 connected in series.

In a typical circuit as depicted in FIG. 1, the lamp 10 was a 100 watt HID metal halide lamp, the line voltage was 277 Volts AC, the inductor ballast reactor 26 had an inductance of 0.5 Henries and a lamp current of 1.0 Amp. The NLC capacitor 30 had a value of 2000 pF and the SIDAC switch had a break over voltage of 300 Volts. The inductor ballast reactor 26 had an inductor coil of L1 and L2 of 0.020 inch copper wire with 550 turns. The ratio L1 to L1+L2 of the tap 28 was varied. The starting pulse voltages were 3.5 to 4.0 KV pulse every half cycle.

Referring now to FIG. 6, there is illustrated the relationship of the starting circuits parameters to the tap ratio (n/N) wherein n equals the number of turns in L1 and N equals the total number of turns in L1 and L2. As can be seen, where it is desirable to cease all starter circuit operations after the lamp started, a tap ratio (n/N) of between about 0.55 to 0.65 and preferably about 0.60 should be selected. The advantages obtained with such a tap ratio are a lower maximum voltage of the NLC, higher output voltages and smaller size starting circuits. Further advantages in size, cost and pulse voltages can be obtained in accordance with the invention by providing a tap ratio of between about 0.3 to 0.4 and preferably 0.35.

FIG. 7 shows the output voltage when using a slow switching SIDAC. As illustrated, the SIDAC does not have to be a very fast device. When selected to be sufficiently slow, the output voltage has the shape as shown. The second pulse, which is $\frac{1}{3}$ the size of the fist pulse, can be helpful in starting the lamp, however, the second pulse is not seen when the tap ratio is below 0.35 as discussed above. The utilization of slower SIDACs as permitted by the present invention allows less costly SIDACs to be used.

Figure 2:
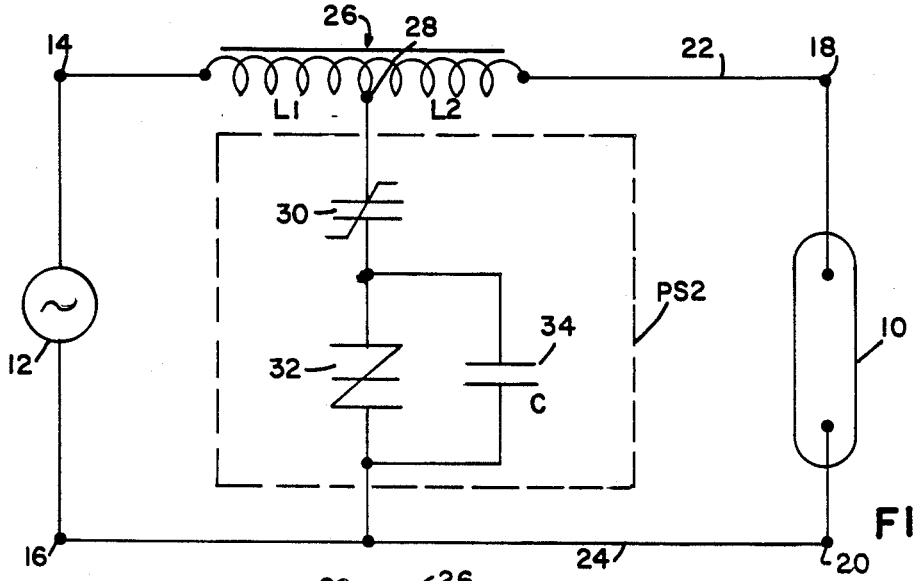
FIG. 2 is a circuit diagram showing a modification of the FIG. 1 embodiment.

FIG. 2 shows a modification of the FIG. 1 circuit. As shown, the starter circuit PS2 includes a component in parallel with the SIDAC switch 32. The paralleling component serves as a voltage divider and cooperates with the SIDAC switch 32 alone to thereby provide more stable operation of the starting circuit PS2. As shown, the paralleling component 34 is a capacitor having, for example, a capacitance range of between about 0.01 to 0.2 MFD depending upon the particular circuit components.

Figure 3:
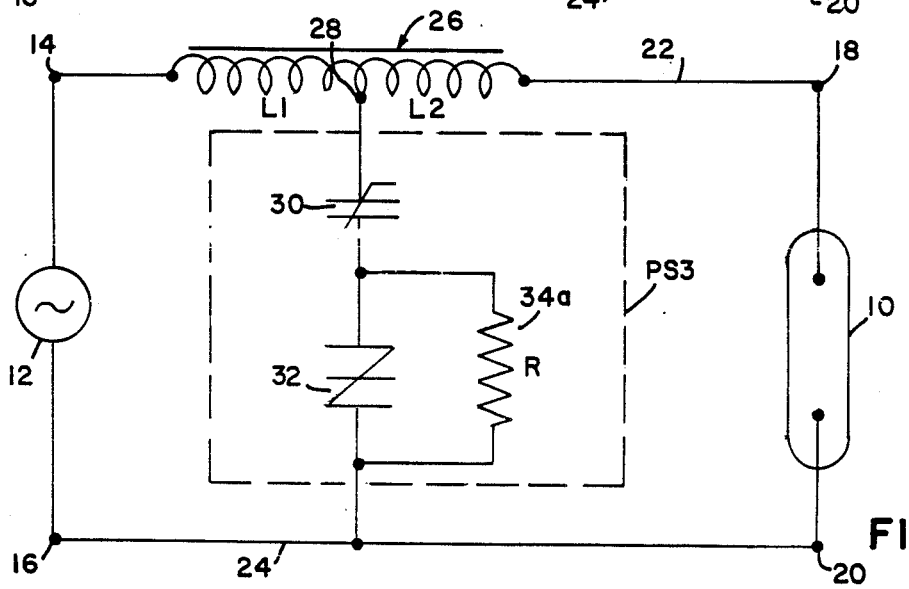
FIG. 3 is a circuit diagram showing a modification of the FIG. 1 embodiment.

FIG. 3 shows a modification of the FIG. 2 embodiment wherein the paralleling component **34*a*** of the starter circuit PS3 is a resistor which, for example, can have a resistance range of between about 0.1 to 1.0 megohms depending upon the particular circuit components.

Figure 4:
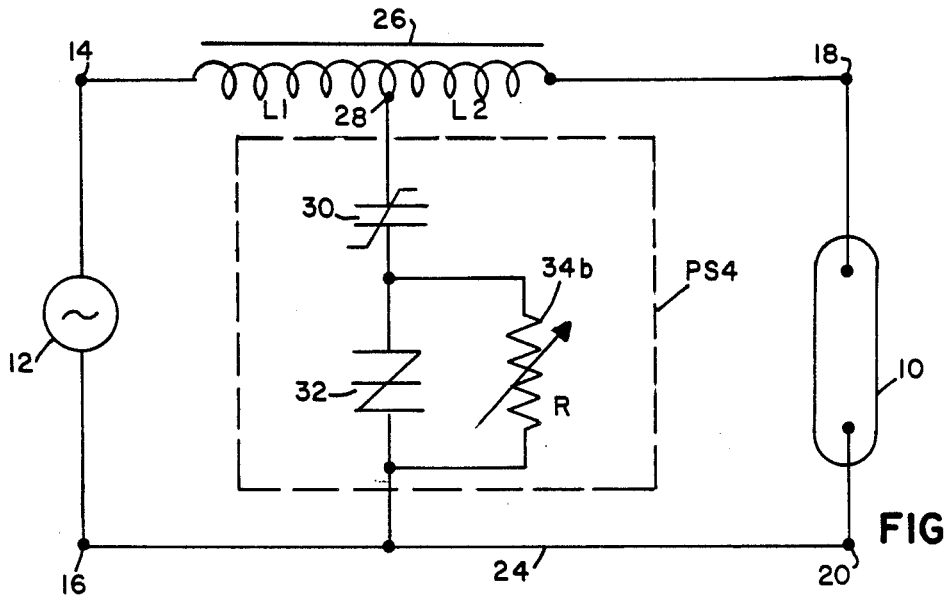
FIG. 4 is a circuit diagram showing a modification of the FIG. 1 embodiment.

FIG. 4 shows a modification of the FIG. 3 embodiment wherein the paralleling component **34*b*** of starter circuit PS4 is a variable resistor which permits the phase and magnitude of the pulse voltage to be varied.

The starter circuits of the present invention can be used with reactor ballasts which include transformer and autotransformer components.

Figure 5:
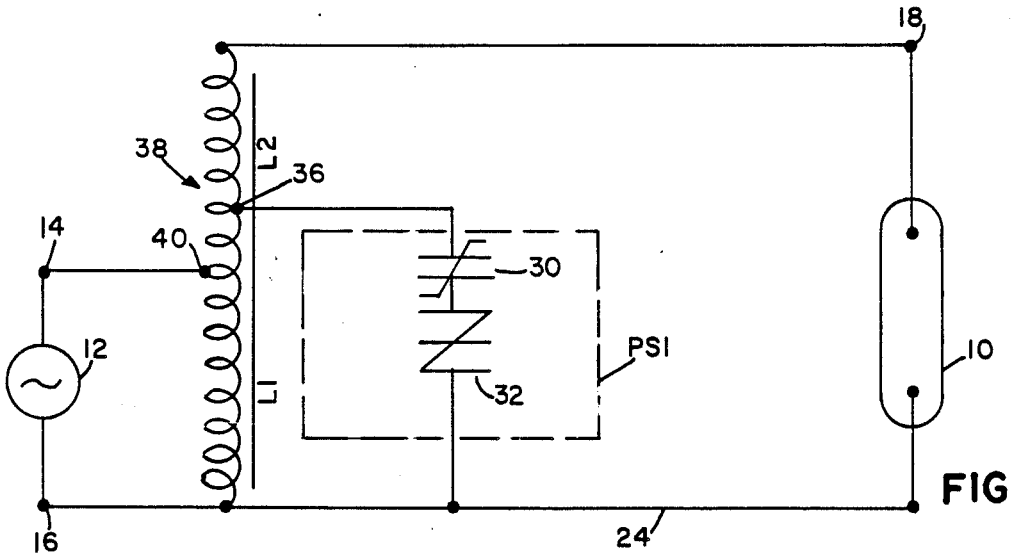
FIG. 5 is a circuit diagram showing a modification of the FIG. 1 embodiment.

FIG. 5 shows a modification of the FIG. 1 embodiment, wherein the starter circuit PS1 is connected by tap 36 to the ballast portion of autotransformer 38 and the AC source 12 is connected by tap 40 to the autotransformer 38. As is commonly known, the autotransformer and reactor ballast windings may both be wound on a common core.

Another feature of the present invention is that the non-linear capacitor (NLC) is preferably formed of a non-linear dielectric material, such as barium titanate composition as is well known. The non-linear dielectric material can be selected to have a Curie point of, for example, between about 90° C. to 100° C. whereby the NLC device can be disabled when such temperature is reached or exceeded. In this application, the temperature can be utilized to disable the starter circuits whenever undesirably high voltage pulses are encountered.

While the invention has been described with respect to preferred embodiments, it will be apparent to those shilled in the art that changes and modifications may be made without departing from the scope of the invention herein involved in its broader aspects. Accordingly, it is intended that all matter contained in the above description, or shown in the accompanying drawings shall be interpreted as illustrative and not in a limiting sense.

What is claimed is:

1. A circuit for starting and operating an electric discharge lamp comprising:

a pair of input terminals for connection to an alternating current supply;

a pair of output terminals for connection across said lamp;

a ballast inductor connected between one of said input terminals and one of said output terminals, said ballast inductor having a tapping point;

a connection between the other of said input terminals and the other of said output terminals; and a high voltage starting pulse means providing a high voltage starting pulse on said lamp connected between said tapping point and said other of said input terminals, said high voltage starting pulse means comprising a non-linear dielectric element means and a semiconductor switch means connected in series.

2. The starting and operating circuit of claim 1 wherein said non-linear dielectric element means comprises a non-linear capacitor.

3. The starting and operating circuit of claim 1 wherein said semiconductor switch means comprises a bi-directional thyristor.

4. The starting and operating circuit of claim 1 further comprising a paralleling means connected across said semiconductor switch means to provide a voltage-divider network means whereby the time to fully charge said non-linear dielectric element means is increased.

5. The starting and operating circuit of claim 4 wherein said paralleling means comprises a capacitor means.

6. The starting and operating circuit of claim 4 wherein said paralleling means comprises a resistor means.

7. The starting and operating circuit of claim 4 wherein said paralleling means comprises a variable resistor means.

8. The starting and operating circuit of claim 1 in combination with a high intensity discharge lamp connected across said output terminals of said circuit.

9. A circuit for starting and operating an electric discharge lamp comprising:

a pair of input terminals for connection to an alternating current supply;

a pair of output terminals for connection across said lamp;

a ballast transformer means having input windings and output windings, said input windings connected to said input terminals and said output windings connected in series with said lamp; said ballast transformer means having a tapping point in said transformer output windings; and a high voltage starting pulse means providing a high voltage starting pulse on said lamp connected between said tapping point and in parallel with said lamp; said high voltage starting pulse means comprising a non-linear dielectric element means and a semiconductor switch means connected in series.

10. A circuit for starting and operating an electric discharge lamp comprising:

a pair of input terminals for connection to an alternating current supply;

a pair of output terminals for connection across said lamp;

a ballast inductor connected between one of said input terminals and one of said output terminals; said ballast inductor having a tapping point intermediate the ends thereof to define a first and second winding portion and having a tap ratio of said first winding portion to the sum of said first and second winding portions of less than unity;

a connection between the other of said input terminals and the other of said output terminals; and a high voltage starting pulse means providing a high voltage starting pulse on said lamp connected between said tapping point and said other of said input terminals; said high voltage starting pulse means comprising a non-linear dielectric element means and a semiconductor switch means connected in series.

11. The circuit for starting and operating an electric discharge lamp of claim 10 wherein said tap ratio is between 0.30 to 0.70.

12. The circuit for starting and operating an electric discharge lamp of claim 10 wherein said tap ratio is less than 0.60 whereby when said circuit is initially energized, said semiconductor switch means is charged until it reaches a predetermined breakdown voltage to fully charge said non-linear dielectric element means to thereby apply a voltage pulse of sufficient magnitude to said ballast inductor to start said lamp and after said lamp is started, the breakdown voltage of said semiconductor switch means is not exceeded, thereby rendering said high voltage starting pulse means inoperative.

* * * * *